United States Patent [19]

Kimzey et al.

[11] 4,355,435

[45] Oct. 26, 1982

[54] SURFACE MAINTENANCE EQUIPMENT

[75] Inventors: Paul W. Kimzey, St. Louis Park; Daniel J. Super, New Hope, both of Minn.

[73] Assignee: Tennant Company, Minneapolis, Minn.

[21] Appl. No.: 186,704

[22] Filed: Sep. 12, 1980

[51] Int. Cl.[3] ..... A47L 5/12

[52] U.S. Cl. ..... 15/347; 15/378; 15/422

[58] Field of Search ..... 15/83-86, 15/340, 347, 348, 349, 378, 422

[56] References Cited

U.S. PATENT DOCUMENTS

| | | | |
|---|---|---|---|
| 918,896 | 4/1909 | Noe | 15/349 X |
| 935,558 | 9/1909 | Spangler | 15/378 |
| 2,239,762 | 4/1941 | Taylor | 15/378 |
| 2,798,243 | 7/1957 | Wex | 15/422 X |

*Primary Examiner*—Chris K. Moore

*Attorney, Agent, or Firm*—Norman P. Friederichs

[57] ABSTRACT

The present invention provides surface maintenance equipment, such as for sweeping lawns, which includes mechanism for preventing clogging of ducts leading to the fan and/or the hopper.

15 Claims, 8 Drawing Figures

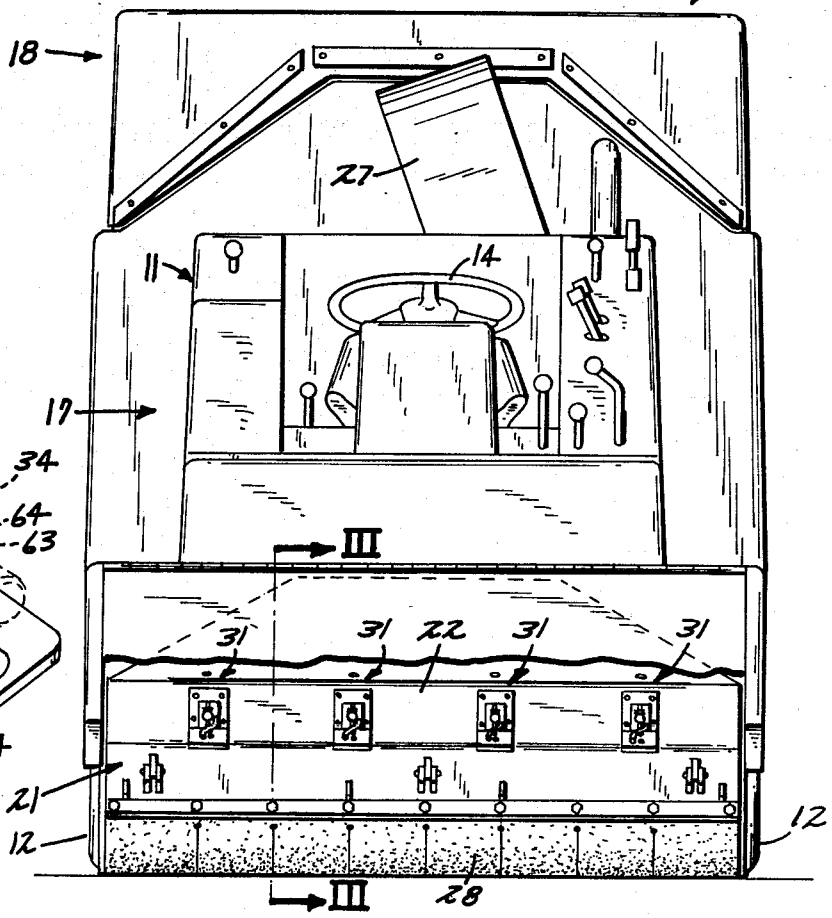
FIG. II
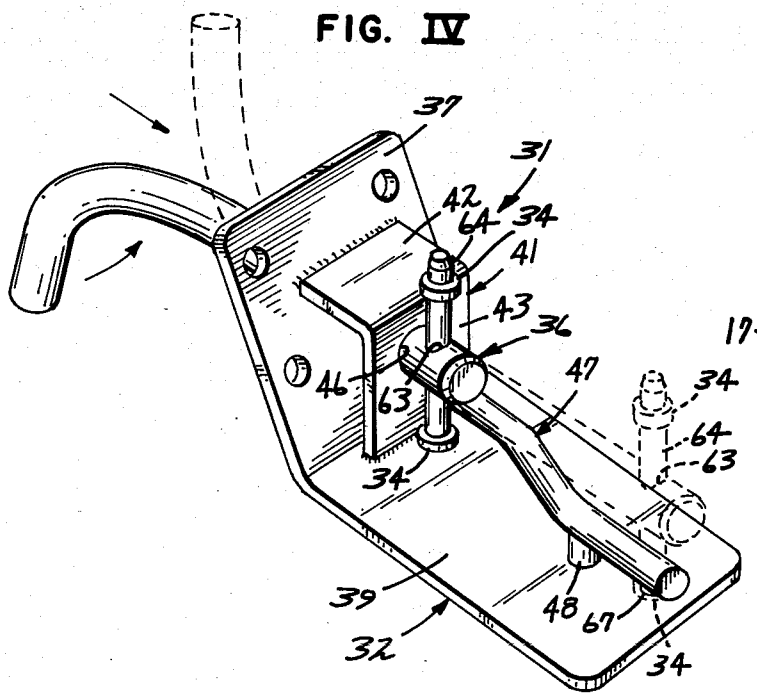
FIG. IV

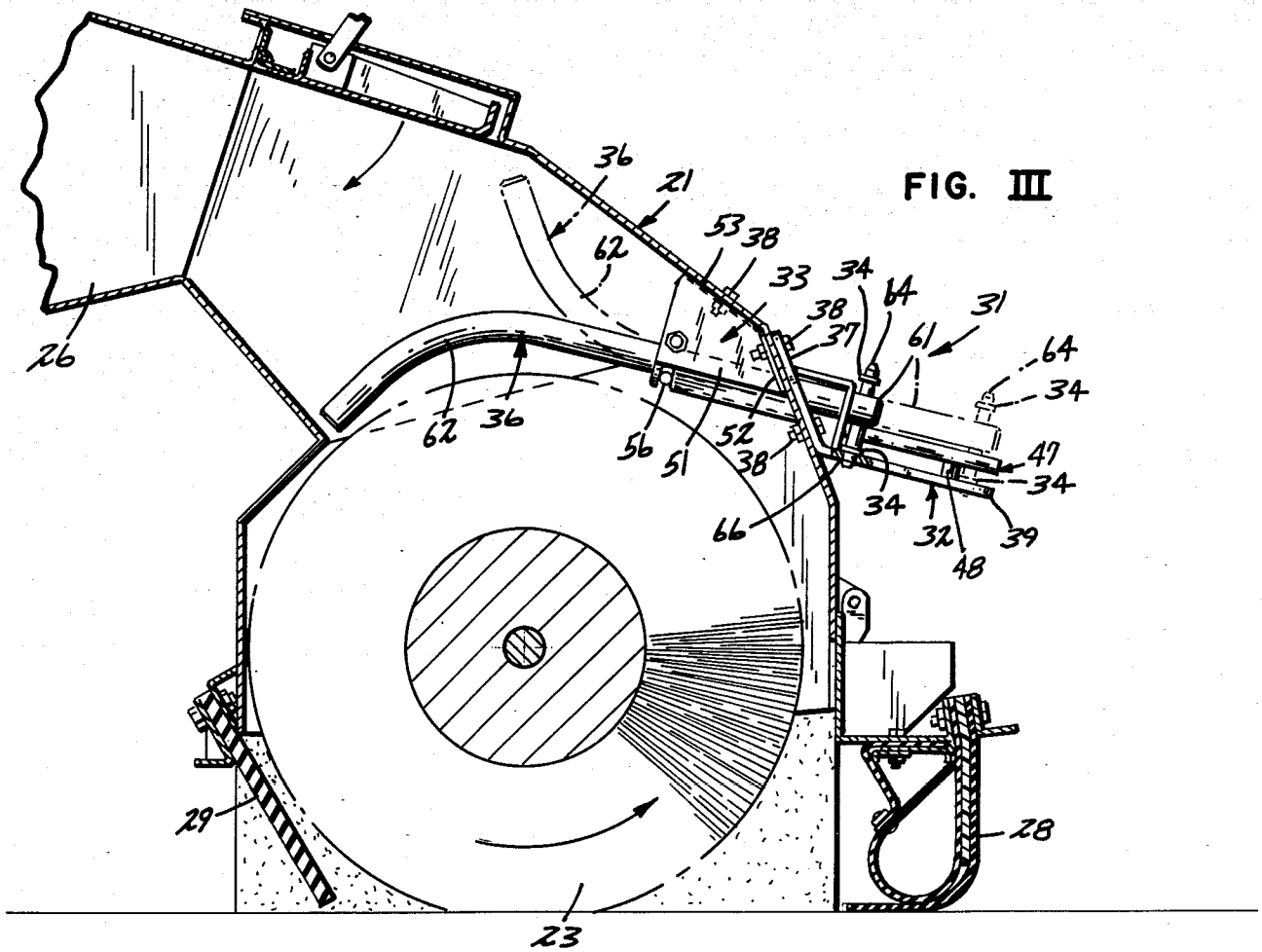
FIG. III

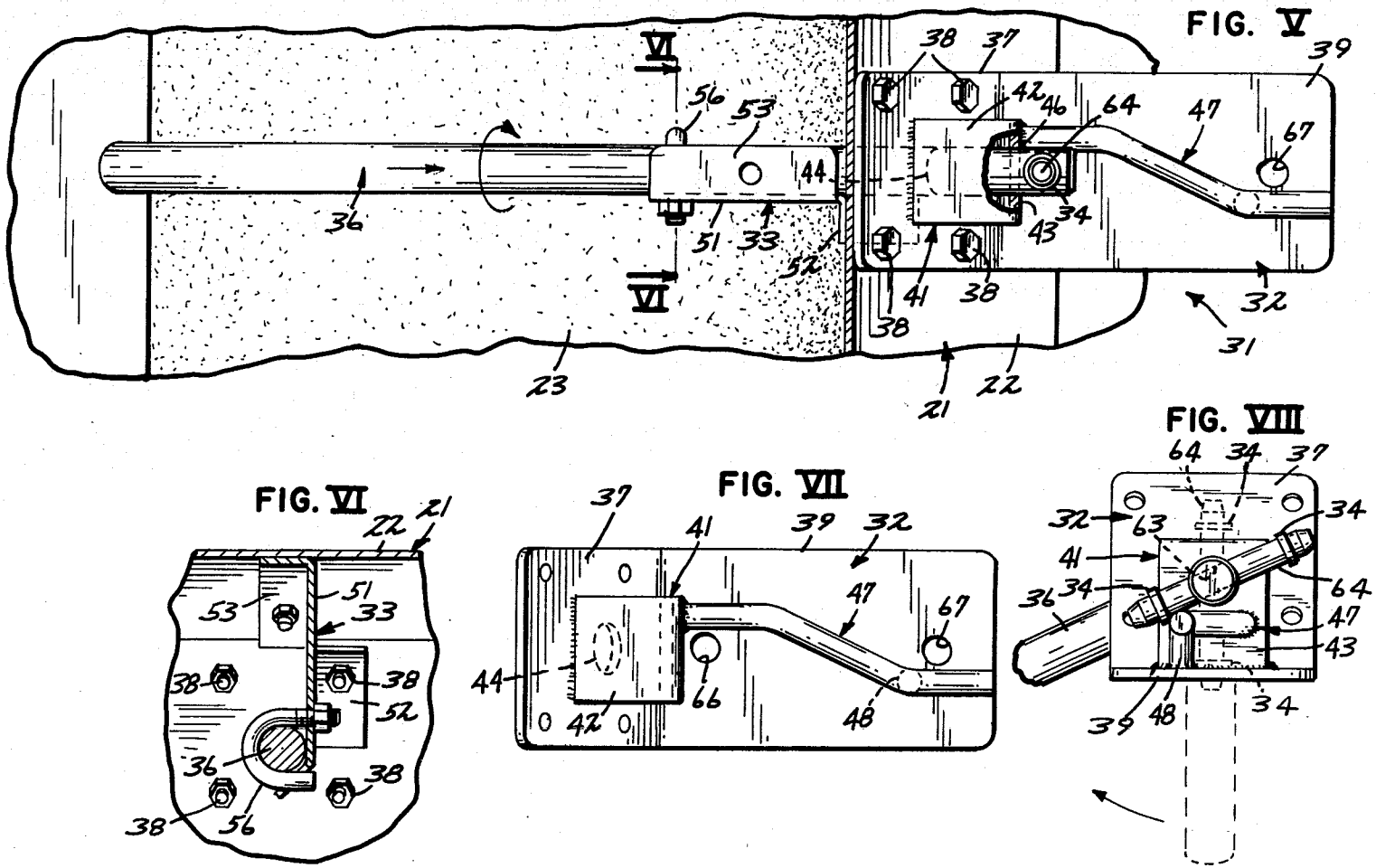
FIG. V
FIG. VIII
FIG. VII
FIG. VI

SURFACE MAINTENANCE EQUIPMENT

TECHNICAL FIELD

The present invention relates to surface maintenance equipment such as sweepers and more particularly to surface maintenance equipment including mechanism for prevention of clogging of the ducts.

BACKGROUND OF THE INVENTION

Surface maintenance equipment is available in a wide variety of types and sizes. Certain of such equipment is designed for indoor use while other is particularly adapted for use in caring for large outdoor areas such as parks, parking lots, and the like. The present invention is generally of the latter type although it is suitable for use in any area where long pieces of debris may be encountered.

Surface maintenance equipment in the past has generally included a body portion which is supported on a plurality of wheels. The equipment may include a power source such as a gasoline engine or electric motor, which may drive certain of the wheels as well as driving the vacuum equipment. The body will usually carry a hopper for containment of dirt and debris which has been picked up. In some instances the hopper may be in the form of a trailer. The device will also have a debris pickup housing which defines a zone from which the dirt and debris is lifted and deposited in the hopper. A rotatably driven cylindrical tool, typically a brush or paddle structure, may be disposed in the pickup housing to assist in lifting the dirt and debris. A duct may provide communication between the debris pickup housing and the hopper. The equipment has a fan which vacuumizes the debris pickup housing and the duct to assist in lifting and carrying debris. In some units the duct has a first portion that is under a vacuum and a second portion that is under a positive pressure. Such surface maintenance equipment of course also includes various controls such as steering mechanisms and speed controls. The general type of equipment contemplated in the present invention is illustrated in U.S. Pat. Nos. 3,837,038 (Kimzey) and 3,881,215 (Krier) which are assigned to the Tennant Company.

Certain problems have been encountered when such known equipment is used in areas having long pieces of debris such as sticks and small tree limbs. For example, a stick may be lifted by the brush and driven into the duct. If the stick is longer than one of the dimensions of the duct, the stick may become lodged therein. Subsequently additional pieces of debris may be lodged in the duct, thereby creating what is commonly termed "bird nesting" or, in other words, plugging of the duct. Such plugging requires shutdown of the equipment and cleaning of the duct, thus producing undesirable down time. In some instances substantial difficulty may be encountered in dislodging the debris from the duct.

SUMMARY OF THE INVENTION

The present invention relates to such equipment including a mechanism for preventing entrance of long pieces of debris into the duct extending from the debris pickup housing to the hopper.

The present surface maintenance equipment may include a motorized body structure which is supported on a plurality of wheels. The equipment has a vacuumized debris pickup housing and duct work extending from the housing to a storage area or hopper. A rotatable tool such as a brush may be provided in the debris pickup housing to assist in lifting debris into the duct and ultimately into the storage area. A lip-like seal or skirt may be provided around the lower edge of the debris pickup housing. The present equipment includes mechanism disposed between the pickup housing and the duct work to prevent movement into the duct work of long pieces of debris which may clog the duct. The clog preventing mechanism may include a plurality of spaced bars which overlie the rotary tool. The spaced bars may be moved from an operative to an out-of-the-way non-operative position.

BRIEF DESCRIPTION OF THE DRAWINGS

In the drawings:

FIG. I is a left side view of surface maintenance equipment of the present invention;

Figure 1:
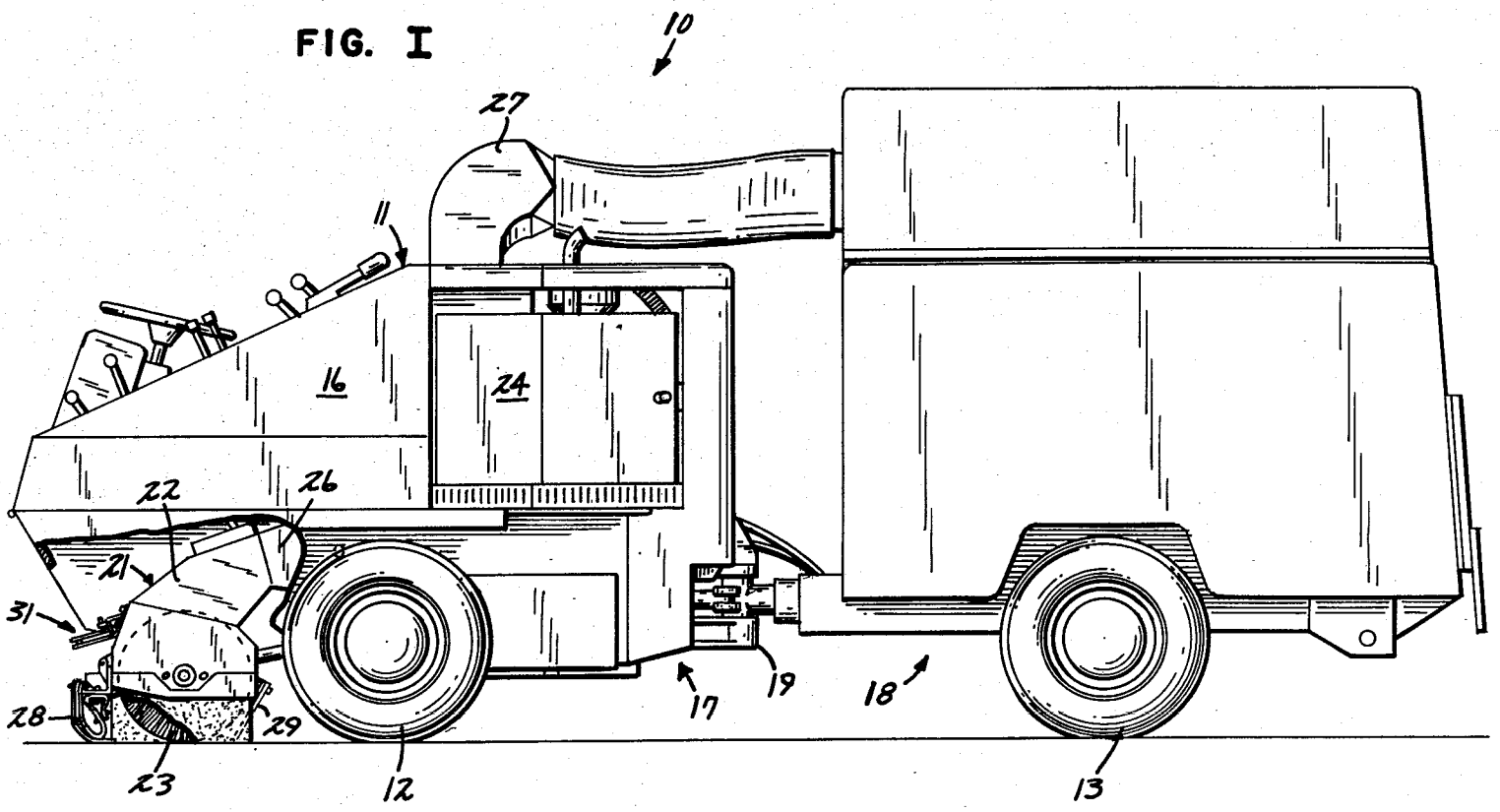

FIG. II is a front view of the present surface maintenance equipment with portions of the housing removed to expose underlying structure;

FIG. III is a sectional view taken along the line III—III in FIG. II;

FIG. IV is a perspective view of a portion of the clog-preventing mechanism;

FIG. V is a top view of a portion of the present surface maintenance equipment with the clog-preventing mechanism in place;

FIG. VI is a sectional view taken along the line VI—VI in FIG. V;

FIG. VII is a top view of a portion of the mechanism of FIG. IV; and

FIG. VIII is an end view of the mechanism of FIG. IV.

DETAILED DESCRIPTION OF THE PRESENT INVENTION

The surface maintenance equipment 10 of the present invention, one embodiment of which is illustrated in FIGS. I–VIII, may include a body structure 11 which is supported on a plurality of wheels 12 and 13. Wheels 12 may be steerable such as by suitable movement of the steering wheel 14 to control the direction traversed by the equipment 10. The wheels 12 may also be driven by a suitable motor or engine 16. In the particular equipment shown in FIG. I the unit includes a cab portion 17 and a trailer portion 18 which are interconnected by a trunion joint 19. Equipment 10 has a pickup assembly 21 including a housing 22 and a rotatably driven pickup tool 23. The pickup housing 22 may be connected to a vacuum-blower fan 24 by a duct 26. The vacuum-blower 24 may in turn be connected to a trailer 18 by a duct 27.

The pickup housing 22 may include a metal-walled housing structure which is downwardly opening and has a plurality of resilient sweeper skirts such as 28, 29 around the periphery thereof. The skirts 28, 29 provide a partial seal between the housing 22 and the surface being cleaned. The rotary tool 23 may be a paddle structure as shown in U.S. Pat. No. 3,837,038, assigned to Tennant Company, or it may be a cylindrical bristle brush structure. The rotary tool 23 may be driven by motor 16 through a chain and sprocket structure. Alternatively, such drive may be direct. The fan 24 may vacuumize the housing 22 and duct 26 to lift debris which is lying on the surface over which the housing 22 passes. The fan 24 further serves to project the debris under positive air pressure through duct 27 and into the hopper provided by trailer 18.

The present surface maintenance equipment includes a clog-preventing assembly 31 which may be mounted overlying and closely adjacent the upper portion of the rotary tool 23 in the discharge area of housing 22. The positioning of the clog-preventing assembly 31 is best viewed in FIG. III. The clog-preventing assembly 31 may include brackets 32 and 33. The brackets 32 and 33 cooperate to carry a push rod 36 which may be extended as shown in solid lines in FIG. III or retracted as shown in broken lines in FIG. III. The rod 36 may be inverted when moved from the extended or operative position to the retracted or inoperative position. The bracket 32 may include a first portion 37 which lies against and is secured to the housing 22 such as by bolts 38. The bracket 32 includes a second portion 39 which is disposed at an angle with respect to portion 37 such that portion 39 lies substantially parallel to the adjacent portion of push rod 36. Bracket 32 also includes a member 41 with a first portion 42 which is welded to bracket portion 37 and a second portion 43 which is welded to bracket portion 39. Bracket portion 37 has an opening 44 defined therein as illustrated, for example, in FIG. V. An opening 46 is defined in bracket portion 43. The openings 44 and 46 are concentric and aligned. The openings 44 and 46 may serve as a track for the push rod 36.

Bracket 32 (FIGS. IV and VII) includes a cam member 47 which is suitably mounted; for example, by a support post 48 adjacent one end with the opposite end being welded to bracket portion 43. The function and operation of the cam member 47 will be described hereinafter.

Bracket 33 (FIGS. III, V, and VI) may be secured on the inside of the housing 22 adjacent bracket 32. Bracket 33 also serves as a support for the push rod 36. Bracket 33 includes a plate-like portion 51 with a pair of oppositely extending flanges 52 and 53. Flange 52 may be secured to housing 22 by bolt 38 and the flange 53 may be secured to housing 22 by bolt 38. The bracket 33 further includes a J-bolt 56 which may loosely surround the push rod 36 to provide a further support point for such push rod.

The push rod 36 may be of solid rod stock and includes a straight portion 61 and an arcuate portion 62. The straight portion 61 may be of sufficient length to permit movement of rod 36 from the retracted position to the extended position. The push rod 36 may have an opening 63 defined therein extending therethrough adjacent the end of the straight portion 61. A pin 64 is slideably received in the opening 63. The pin 64 may have slip ring 34 at each end to retain the pin 64 trapped in opening 63.

The bracket 32, as illustrated in FIGS. VII and VIII, may have a pair of openings 66, 67 therein into which an end of pin 64 may be lodged to hold the rod 36 in the extended and retracted positions, respectively.

The above description sets forth in detail only one of a plurality of the clog-preventing assemblies which are mounted on each unit of the present invention. Reference is made to FIG. II, which shows the general location of the various clog-preventing assemblies which are spaced across the upper portion of the pickup housing 22. Although only four of such devices are illustrated in FIG. II, it is to be recognized that fewer or more units may be provided thereacross if desired, depending on the particular application.

Operation of the Present Invention

Although the operation of the present invention would be apparent from the preceding description, it will be further detailed hereinafter in order to assure a more complete understanding of the present invention.

When the operator of the surface maintenance equipment 10 is operating in an area which is substantially free from long pieces of debris, it may desirable to retract the anti-clog devices 31 to provide a more open duct. For example, if the equipment 10 is operated in an area which is primarily covered with leaves, there is no present need for operation of the clog-preventing devices 31. In that instance the devices 31 may be manually moved to the position illustrated in the broken lines in FIGS. III and IV. In such position, the arcuate portion 62 is directed upwardly. The pin 64 extends downwardly along the righthand side of the rod 36 as illustrated in FIG. IV. The pin 64 is pushed downwardly such that the end is entrapped in the opening 67 in bracket 32.

If the operator must then clean an area in which long pieces of debris are found, the clog-preventing devices 31 may be placed in an operable position by slightly lifting the pin 64 to free from opening 67 and pushing the rod 36 forwardly, as illustrated in FIG. IV, to the solid line position. In so doing, the cam member 47 acts on the pin 64, requiring inversion of the rod 36, thereby directing downwardly the arcuate portion 62 of rod 36. Once the rod 36 is in the fully extended position, the pin 64 is pushed downwardly such that the end is engaged in the opening 66, thereby locking the rod 36 in the operable position.

Once each of these clog-preventing devices is in the operable position, the operator then proceeds to clean the area having the long pieces of debris.

When the equipment 10 encounters long pieces of debris, the pieces are lifted by the cylindrical tools 23 until the pieces encounter the rods 36. The long pieces of debris will generally strike the rods 36 with sufficient force to break into short pieces which can readily pass through the duct 26. If, however, the long pieces of debris are not broken up, the pieces will not be permitted to pass by the rods 36 but rather will be kicked on around and downwardly by the rotary tool 23 to pass again beneath the tool and upwardly to strike the rods 36 and thus be broken up. The pieces may be kicked out from beneath the housing 22 if too large to be broken up. Thus the very large diametered piece may be picked up by hand.

Of course, various modifications can be made to the present invention without departing from the broader scope thereof. For example, the hopper provided by trailer portion 18 and the entire duct system may be vacuumized.

What is claimed is:

1. Surface maintenance equipment comprising a body structure, a plurality of wheels for supporting said body structure, a downwardly opening housing defining a pickup chamber, said housing having a debris exit, said housing being carried by said body structure, means for storage of dirt and debris which are picked up from said chamber, duct means for interconnecting said housing and said storage means, a plurality of spaced, anti-clog bars overlying the exit of said housing whereby said anti-clog bars prevent oversized debris from entering and clogging said duct means.

2. The equipment of claim 1 wherein said equipment includes means for vacuumizing at least a portion of said duct means and wherein said anti-clog bars are retractable to provide an open duct means.

3. The equipment of claim 2 wherein said anti-clog bars are individually retractable.

4. The equipment of claim 1 wherein a rotatably driven cylindrical tool is disposed in said housing to assist in lifting debris into the duct means and wherein said anti-clog bars have an arcuate-shaped portion which immediately overlies said cylindrical tool.

5. The equipment of claim 4 wherein said bars are retractable.

6. The equipment of claim 5 wherein said bars are invertible when moved from an extended position to a retracted position.

7. A sweeper comprising body means supported on a plurality of wheels, said body means carrying a rotatably driven cylindrical tool and a downwardly opening housing closely surrounding said tool, said body means further carrying a hopper and duct means interconnecting said housing and said hopper, said sweeper including means for vacuumizing said housing and at least a portion of said duct means, clog prevention bars disposed at a location between said housing and said duct means to prevent overlength debris from entering and clogging said duct means, said clog prevention bars being extendible to an operative position and retractable to an inoperative position.

8. A sweeper comprising:

body means supported on a plurality of wheels, said body means including a hopper and a paddle housing, means for interconnecting said hopper and housing;

rotatably driven paddle means supported in said housing;

a vacuum fan for vacuumizing said housing; and means to prevent overly long debris from clogging said interconnecting means.

9. The sweeper of claim 8 wherein said clog-preventing means comprise a plurality of spaced bars which overlie said paddle means.

10. The sweeper of claim 9 wherein said spaced bars are extendible to an operable position and retractable to a non-operable position.

11. The sweeper of claim 10 wherein said bars each include an arcuate portion, said arcuate portion being downwardly opening when in the operable position and upwardly when in a non-operable position.

12. The sweeper of claim 11 wherein said sweeper includes means for requiring inversion of said bars when moved from the operable position to the non-operable position.

13. The sweeper of claim 12 wherein said sweeper includes cam means for requiring inversion of said bars when moving from the operable position to the non-operable position.

14. The sweeper of claim 13 wherein said fan is connected to said housing by duct means and connected to said hopper by duct means whereby said connecting duct means to said housing is vacuumized and said connecting duct means to said hopper carries a positive pressure airstream.

15. The sweeper of claim 13 wherein said fan also vacuumizes said hopper.

* * * * *